US008740052B2

(12) United States Patent
Drummond

(10) Patent No.: US 8,740,052 B2
(45) Date of Patent: Jun. 3, 2014

(54) MEMBRANE CLOSURE FOR CONTAINER

(75) Inventor: Michael T. Drummond, Laurinburg, NC (US)

(73) Assignee: Sonoco Development, Inc., Hartsville, SC (US)

( * ) Notice: Subject to any disclaimer, the term of this patent is extended or adjusted under 35 U.S.C. 154(b) by 2021 days.

(21) Appl. No.: 11/278,986

(22) Filed: Apr. 7, 2006

(65) Prior Publication Data

US 2007/0235512 A1 Oct. 11, 2007

(51) Int. Cl.
*B65D 43/02* (2006.01)

(52) U.S. Cl.
USPC ..... 229/123.1; 229/245; 220/257.1

(58) Field of Classification Search
USPC ..... 229/123.1, 245; 220/257.1, 359.2
See application file for complete search history.

(56) References Cited

U.S. PATENT DOCUMENTS

| | | | | |
|---|---|---|---|---|
| 3,317,068 | A | | 5/1967 | Betner |
| 4,260,061 | A | | 4/1981 | Jacobs |
| 4,411,365 | A | | 10/1983 | Horikawa et al. |
| 4,552,269 | A | | 11/1985 | Chang |
| 4,556,152 | A | | 12/1985 | Bogren |
| 4,610,357 | A | | 9/1986 | Nakamura |
| 4,653,250 | A | | 3/1987 | Nakamura |
| 4,679,693 | A | | 7/1987 | Forman |
| 4,723,301 | A | | 2/1988 | Chang |
| 4,790,436 | A | | 12/1988 | Nakamura |
| 4,840,270 | A | | 6/1989 | Caputo et al. |
| 4,938,390 | A | | 7/1990 | Markva |
| 4,960,216 | A | * | 10/1990 | Giles ..... 215/232 |
| 4,961,986 | A | | 10/1990 | Galda et al. |
| 5,004,111 | A | | 4/1991 | McCarthy |
| 5,065,868 | A | | 11/1991 | Cornelissen et al. |
| 5,158,499 | A | | 10/1992 | Guckenberger |
| 5,176,314 | A | * | 1/1993 | Akazawa et al. ..... 229/125.35 |
| 5,433,992 | A | | 7/1995 | Galda et al. |
| 5,514,442 | A | | 5/1996 | Galda et al. |
| 5,531,325 | A | | 7/1996 | Deflander et al. |
| 5,560,989 | A | | 10/1996 | Han |
| 5,579,943 | A | * | 12/1996 | Johnson ..... 220/258.2 |
| 5,702,015 | A | | 12/1997 | Giles et al. |

(Continued)

FOREIGN PATENT DOCUMENTS

| | | |
|---|---|---|
| EP | 0 661 154 | 7/1995 |
| EP | 0 905 048 | 3/1999 |

(Continued)

OTHER PUBLICATIONS

Search Report for corresponding European Patent Application No. 07251137.1 completed May 9, 2007.

*Primary Examiner* — Gary Elkins
*Assistant Examiner* — Christopher Demeree
(74) *Attorney, Agent, or Firm* — Alston & Bird LLP

(57) ABSTRACT

A membrane closure for a container is provided. The membrane closure includes an integral tab for removing the membrane closure from the container. The closure includes a lower layer, an adhesive layer, and an upper layer. The lower layer is sealed to the body of a container. The upper layer includes a score pattern that defines a tab area and a fixed area. The adhesive layer includes a first adhesive for releasably attaching the tab area to the lower layer and a second adhesive for permanently bonding the fixed area to the lower layer. The membrane closure is removable from the container by pulling on the tab area.

21 Claims, 3 Drawing Sheets

(56) References Cited

U.S. PATENT DOCUMENTS

| | | | | |
|---|---|---|---|---|
| 5,709,310 | A | 1/1998 | Kretz | |
| 5,873,483 | A | 2/1999 | Görtz et al. | |
| 6,056,141 | A | 5/2000 | Navarini et al. | |
| 6,196,450 | B1 * | 3/2001 | Varadarajan et al. | 229/123.2 |
| 6,383,592 | B1 | 5/2002 | Lowry et al. | |
| 6,450,685 | B1 | 9/2002 | Scott | |
| 6,457,585 | B1 | 10/2002 | Huffer et al. | |
| 6,497,336 | B2 | 12/2002 | Grayer | |
| 6,517,243 | B2 | 2/2003 | Huffer et al. | |
| 6,554,134 | B1 | 4/2003 | Guibert | |
| 6,857,561 | B2 | 2/2005 | Williams et al. | |
| 6,866,926 | B1 | 3/2005 | Smelko et al. | |
| 6,918,532 | B2 | 7/2005 | Sierra-Gomez et al. | |
| 2003/0085265 | A1 * | 5/2003 | Haim | 229/123.1 |
| 2003/0231811 | A1 | 12/2003 | Hodson et al. | |
| 2004/0013827 | A1 * | 1/2004 | Zuser et al. | 428/34.1 |
| 2005/0247713 | A1 | 11/2005 | Niederer et al. | |
| 2005/0247764 | A1 | 11/2005 | Sierra-Gomez et al. | |

FOREIGN PATENT DOCUMENTS

| | | | | |
|---|---|---|---|---|
| EP | 1 449 789 | | 8/2004 | |
| JP | 2000062825 A | * | 2/2000 | B65D 47/36 |
| WO | WO 02/066341 | | 8/2002 | |
| WO | WO 03/059776 | | 7/2003 | |

* cited by examiner

MEMBRANE CLOSURE FOR CONTAINER

BACKGROUND OF THE INVENTION

1) Field of the Invention

The present invention relates to membrane-type closures for product containers.

2) Description of Related Art

Conventional containers for snack foods and other products often have a membrane closure sealed to a top rim of the container and an overcap covering the membrane. The container is initially opened by the consumer by removing and discarding the membrane. Typically, the membrane includes an outwardly projecting tab to aid in the removal of the membrane. The overcap is provided to allow the consumer to re-close the container once the membrane is removed.

In addition to re-closing the container, the overcap is beneficial to the manufacturer and packager of the container. For example, the overcap prevents dust, grease, and other containments from collecting on the container's top membrane closure during the manufacturing and packaging operations. Also, the overcap effectively holds down the tab of the membrane closure against the container and reduces the probability of the tab getting caught or damaged on the equipment during the manufacturing and packaging operations.

Specifically, the membrane closure and the tab are usually cut from a membrane web material as a single piece. The membrane closure is sealed to the container with the tab extending horizontally off the side of the container. When the overcap is applied, the skirt of the overcap engages and pushes the tab down and along the side of the container, where the tab is less likely to get caught or damaged.

However, in order to engage and push the tab down, the overcap must overcome the additional material from the tab along the container bead, which adds to the difficulties of the overcap application process. Also, in some applications, an overcap adds little to no value for the consumer. For example, in a single-serving container the overcap is discarded with the membrane closure after the initial opening because there is no need to use the overcap to reclose the container. In such applications, it would beneficial to eliminate the overcap. However, as mentioned above, without the overcap the tab of the membrane closure is more likely to interfere with the manufacturing and packaging operations.

Alternative methods of securing or handling the tab have been considered. For example, the tab may be folded back and heat sealed to the rest of the membrane closure or a material may be used for the membrane closure and tab that allows for the tab to be folded into place (i.e., dead fold retention) either against the rest of the membrane closure or along the side of the container. However, these methods add excessive cost or complexity to the operations.

In light of the foregoing there remains a need to provide a sealable membrane closure for containers that alleviates the need of an overcap to prevent the collection of containments onto the membrane closure or to secure the removal means of the membrane closure, i.e. the tab, into a safer position. As always, it would be beneficial for such a membrane closure to be cost-effective and simple to produce.

BRIEF SUMMARY OF THE INVENTION

The present invention addresses one or more of the above needs by providing a membrane closure for a container. The membrane closure includes an integral tab for removing at least a portion of the membrane closure from the container. The tab does not extend beyond the container and, thus, minimizes the likelihood of the tab interfering with or being damaged by the manufacturing and packaging operations. Moreover, the tab is releasably secured to the rest of the membrane closure by an adhesive. The adhesive further reduces the likelihood of the tab interfering with the manufacturing and packaging operation. Also, because of the adhesive a particular amount of force is required to start the opening feature, i.e. the tab, of the container, which is preferred by many consumers. The membrane closure may also include a material for the outer or top surface of the membrane closure that does not readily soil, which adds to the aesthetics and cleanliness of the container.

According to one embodiment, the membrane closure includes a lower layer, an upper layer, and an adhesive layer. The upper layer has a score pattern that defines a first area and a second area. More specifically, the first area forms a tab. The adhesive layer has a first adhesive for attaching the first area to the lower layer and a second adhesive for attaching the second area to the lower layer. The second adhesive is stronger than the first adhesive.

The score pattern may be symmetric or non-symmetric. For example, the score pattern may include two opposite and symmetric lines of weakening that diverge from a common inner point and extend outwardly toward an outer periphery of the membrane closure. Each line of weakening may include an end portion that extends along or away from the outer periphery. Each line of weakening may include a slit portion and a perforated portion.

The first adhesive may be a pressure-sensitive adhesive or low bond-strength adhesive. The second adhesive may be a laminating adhesive or a high bond-strength adhesive. The lower layer may include a barrier material for serving as a barrier to the passage of liquids and gasses and the upper layer may include a top surface formed from a material not readily soiled. Also, the adhesive layer may include an adhesive-free region.

In another aspect, the present invention may provide a container having the membrane closure as described above. The structure and type of the container may vary. For example, the container may be a paperboard container or a molded plastic container. The container includes a body that defines an interior for storing products and an opening into the interior. The lower layer of the membrane closure includes a bottom surface and a top surface. The bottom surface is sealed to the body by a seam. The membrane closure is removable from the container substantially along the seam by pulling the first tab area.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION OF THE INVENTION

Figure 1:
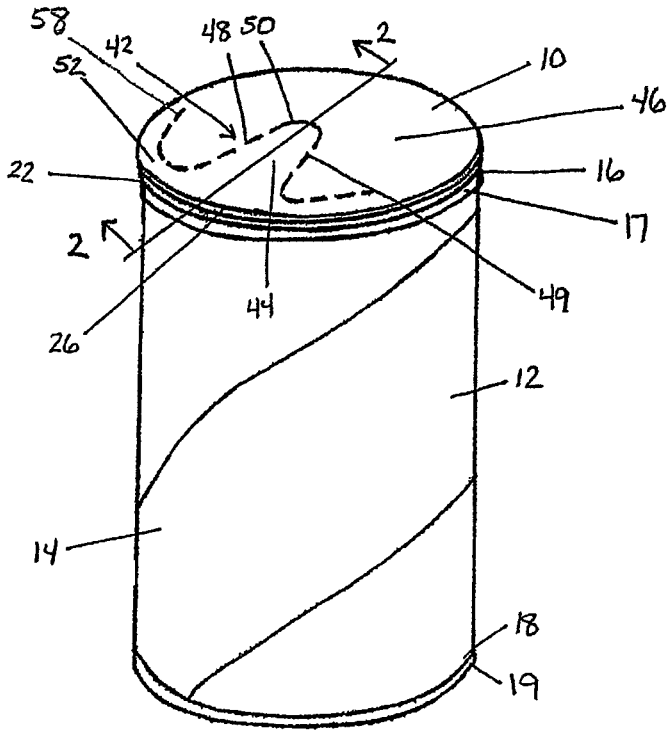
FIG. 1 is a perspective view of a container with a membrane closure according to an embodiment of the present invention.

The present invention now will be described more fully hereinafter with reference to the accompanying drawings in which some but not all embodiments of the invention are shown. Indeed, this invention may be embodied in many different forms and should not be construed as limited to the embodiments set forth herein; rather, these embodiments are provided so that this disclosure will satisfy applicable legal requirements. Like numbers refer to like elements throughout.

The present invention provides a membrane closure 10 for a container 12. The membrane closure may be adapted for various containers. For example, the container may be a spirally wound paperboard container or a molded plastic container, as known in the art. For illustrative purpose only, the figures depict a container 12 with a tubular body 14 that extends from a top end 16 to a bottom end 18 and defines an interior 20 for storing one or more products. The tubular body is particularly beneficial for packaging food products such as potato crisps or peanuts. Although illustrated as having a circular cross sectional shape, the cross sectional shape of the container may vary.

The body may include at least one structural body ply and be formed by wrapping a continuous strip of body ply material, such as paperboard, around a mandrel of a desired shape to create the body structure. The body ply strip may be spirally wound around the mandrel or passed through a series of forming elements so as to be wrapped in a convolute shape around the mandrel. At the downstream end of the mandrel, the body structure may be cut into discrete container bodies.

The body may also include an innermost liner ply. The liner ply may be supported or unsupported as described in U.S. Pat. No. 6,270,004, which is assigned to the assignee of the present invention and is herein incorporated by reference. In general, the liner prevents liquids from leaking out of the container and prevents liquids from entering the container and contaminating or degrading the products contained within the interior of the container. The liner may also be resistant to the passage of gases, so as to prevent odors of the products in the container from escaping or preventing atmospheric air and/or water vapor from entering the container and possibly spoiling the products. The liner ply may have multiple layers including polymeric layers and barrier layers as described in U.S. Patent Application Publication No. 2003/0038170, which is assigned to the assignee of the present invention and is herein incorporated by reference.

The bottom end 18 of the illustrated container 12 defines a bottom opening (not visible in the figures). The bottom opening may be hermetically closed by any suitable closure 19, such as a crimped metal end or double seamed end or the like, as known in the art.

The membrane closure 10 of the present invention may be adapted for closing the top opening of the container 12, which is defined by the top end 16. According to an embodiment of the present invention, the membrane closure 10 includes a lower layer 22, an adhesive layer 24, and an upper layer 26. The lower layer 22 has a bottom surface 28 facing the container 12 and a top surface 30 facing away from the container 12. The bottom surface 28 is attached substantially along the top end 16 of the container in order to close and seal the top opening. More specifically, the top end 16 may be rolled outwardly to form a rim 17 or a curl or a bead as known in the art. The rim 17 may provide a sealing surface for attaching or engaging the bottom surface 28 of the lower layer. As shown, the bottom surface 28 may be defined by a heat-sealable portion or coating 32 of the lower layer for heat sealing the lower layer 22 to the rim 17 or an adhesive or other suitable sealant may be applied for sealing the lower layer to the top end.

The lower layer 22, as well as the rest of the membrane closure 10, is configured to be removable from the container 12. For example the attachment of the lower layer 22 to the top rim 17 may define a seam 36 between the membrane closure 10 and the container 12. The peel strength of the seam 36 is weaker than the ultimate strength of the lower layer 22. Therefore, after sealing the lower layer 22 to the container 12, the lower layer 22 may be peeled from the container 12 substantially along the seam 36.

The lower layer 22 may also include a barrier material or portion 34 that serves as a barrier to the passage of liquids and/or gasses such as oxygen. For example, the barrier material 34 may be any of the following: aluminum foil, polyethylene terephthalate (PET), modified polyethylene terephthalate, polyethylene napthalate, polyamide, metallized and silicate coated polyester, metallized and silicate coated polypropylene, metallized polyamide, polyvinylidiene chloride, ethylene vinyl alcohol, and mixtures thereof The upper layer 26 includes a top surface 38 facing away from the container 12 and a bottom surface 40 facing toward the container 12. As explained in more detail below, the adhesive layer 24 attaches the bottom surface 40 of the upper layer to the top surface 38 of the lower layer. The upper layer 26 may include a variety of materials. For example purposes only, and not by way of limitation, the upper layer may comprise polyethylene terephthalate, modified polyethylene terephthalate, polyethylene napthalate, or any other material for providing a top surface that is not readily soiled. The thickness of the upper layer 26 may vary. For example, in one embodiment, 48 gauge PET may be used to form the upper layer.

As illustrated, the upper layer 26, as well as the lower layer 22, may be shaped to generally overlie the top end 16 of the container 12 and extend minimally, if at all, beyond the body 14 of the container. In some applications, not extending beyond the container body would be beneficial in that it would reduce the risk of the membrane closure getting snagged, caught, or damaged during the manufacturing and packaging operations. For example, in the illustrated embodiment, the upper layer 26 and the lower layer 22 are generally circular in shape to match the circular shaped top end 16 of the container.

Figure 5:
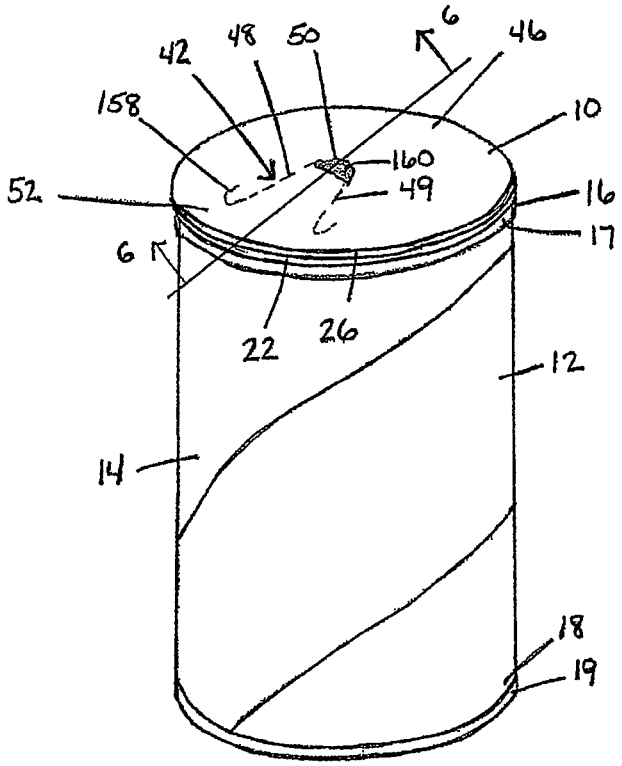
FIG. 5 is a perspective view of the container and membrane according to another embodiment of the present invention.

As best seen in FIG. 1, the upper layer 26 includes a score pattern 42. The score pattern 42 defines a first tab area 44 and a second fixed area 46 of the upper layer. The shape and size of the score pattern may vary. In general, the score pattern 42 is adapted for providing or forming a means for removing the membrane closure 10 from the container 12, referred to herein as a tab. For example, and as illustrated, the score pattern 42 may have a "U" or "V" shape formed by two opposite and symmetric lines of weakening 48, 49 that diverge from a common inner point 50 or apex and extend outwardly toward an outer periphery 52 of the membrane closure. Each of the lines of weakening 48, 49 may also include an end portion 58 that extends along the outer periphery 52 for a predetermined distance in an opposite direction from the other line of weakening, as illustrated in FIG. 1. In particular, as the end portions 58 of the lines of weakening extend along the outer periphery, they are generally extending in a circular manner and parallel to and inside of the seam between the top end of the container and the membrane closure. The end portions 58 are exaggerated in length in FIG. 1. The end portions 158 alternatively can be curved away from the outer periphery 52 as shown in FIG. 5. Such end portions 158 help prevent tearing of the upper layer 26 when the tab 44 is pulled. Also, the natural tear properties of the upper layer material may be used to help control the tearing in the upper layer. For example, as stated above, the material of the upper layer may be polyethylene terephthalate, which has a lesser resistance to tearing in one predetermined direction, referred to herein as a tear direction. The tear direction may be aligned with portions of the lines of weakening to promote tearing along the lines. Although the illustrated embodiments depict generally symmetric score patterns and a symmetric membrane closure, it should be understood that other embodiments of the present invention may include non-symmetric score patterns and/or non-symmetric membrane closures.

Figure 3:
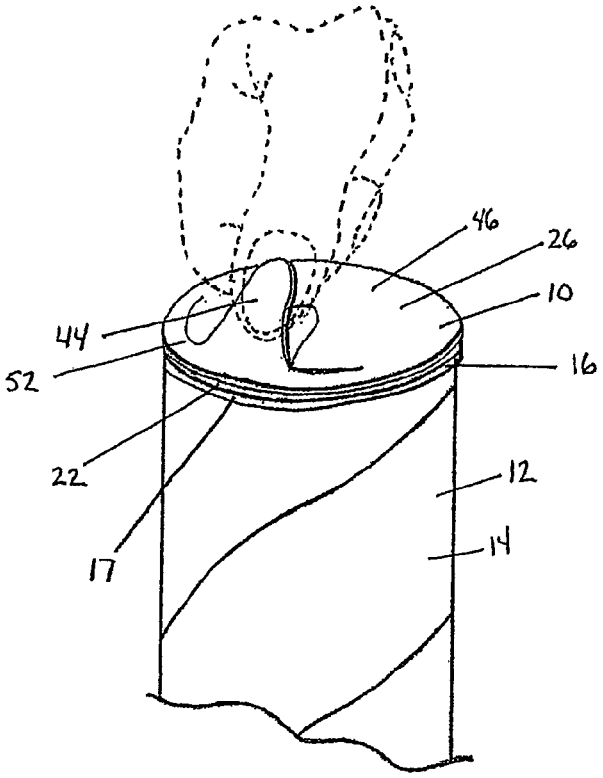
FIG. 3 is a partial perspective view of the container and membrane closure of FIG. 1 illustrating the separation of the tab away from the lower layer of the membrane closure.

The lines of weakening 48, 49 may include slits, perforations or other alterations that are intended to weaken the upper layer 26 along the lines 48, 49 such that the upper layer 26 is likely to tear along the lines 48, 49. For example, the lines 48, 49 may start as a slit near the inner point 50 (or the closed end of the "U" or "V") of the score pattern and become a series of perforations as the lines extend to the outer periphery 52 (or the open end of the "U" or "V"). The slit near the inner point 50 of the score pattern is intended to allow a user to grasp the first tab area 44 at the apex 50 and then lift the rest of the first tab area 44 of the upper layer away from the lower layer 22, as shown in FIG. 3.

Figure 2:
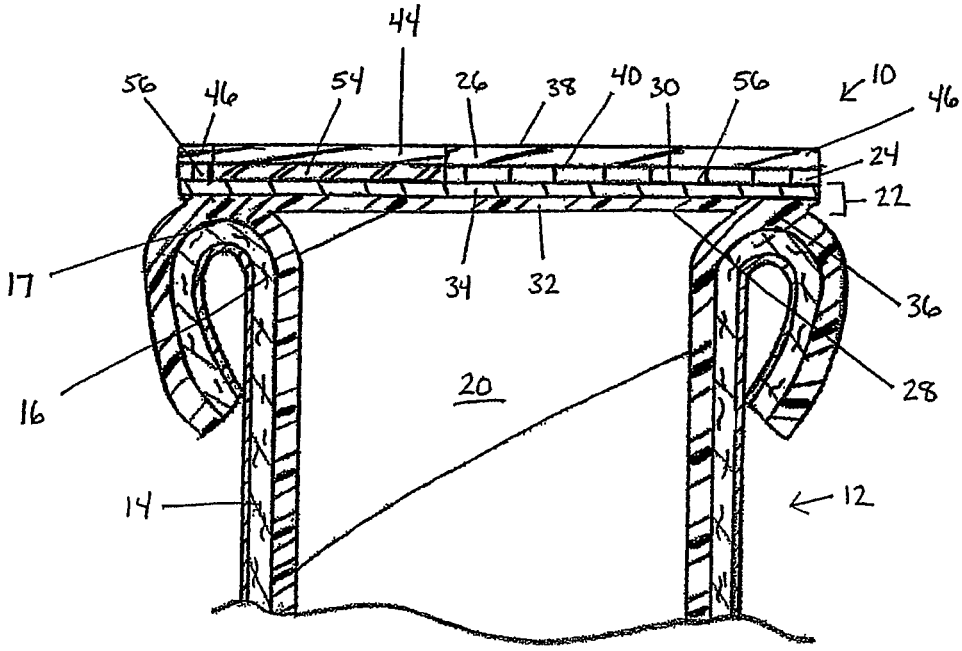
FIG. 2 is a cross-sectional view of the container and membrane closure in FIG. 1 taken along line 2-2.

As mentioned, the adhesive layer 24 connects the upper layer 26 to the lower layer 22. More specifically and as shown in FIG. 2, the adhesive layer 24 includes a first adhesive 54 for connecting the first tab area 44 of the upper layer to the lower layer 22 and a second adhesive 56 for connecting the second fixed area 46 of the upper layer to the lower layer 22. The second adhesive 56 is for substantially holding or fixing the second fixed area 46 of the upper layer to the lower layer 22, including while the first tab area 44 is being pulled away from the lower layer and while the membrane closure 10 is lifted away from the container 12. The second adhesive may be a variety of adhesives, such as a high bond-strength or "permanent" laminating adhesive. One consideration is that the second adhesive 56 is stronger than the first adhesive 54 such that the second fixed area 46 of the upper layer remains substantially fixed to the lower layer 22 while the first tab area 44 is being pulled away from the lower layer 22. Also, the second adhesive 56 may be effectively stronger than the seam 36 between the membrane closure and the container such that the second fixed area 46 of the upper layer remains substantially fixed to the lower layer 22 while the membrane closure 10 is being pulled away from the container 12.

One of the features of the present invention is the first adhesive 54 connecting the first tab area 44 of the upper layer to the lower layer 22. To allow the first tab area 44 to be lifted away from the lower layer 22 with a minimal likelihood of tearing outside of the score pattern 42, the peel strength of the first adhesive 54 is less than the ultimate strength of the first tab area 44. The first adhesive may be a variety of adhesives, such as a peelable or low bond-strength adhesive or a pressure-sensitive adhesive. The first adhesive 54 is intended to reduce the likelihood of an inadvertent lifting of the first tab area 44 or the likelihood of the first tab area 44 interfering with or being damaged by the manufacturing and packaging operations. Moreover, consumers prefer that some amount of force is required to start an opening feature of a container. In some applications, a required opening force may reassure a consumer on the integrity of the container.

The membrane closure 10 may be made from a variety of methods. For example purposes only, and not by way of limitation, the adhesives 54, 56 may be pattern-printed onto one of the layers 22, 26, followed by adhesive lamination of the layers to each other. The scoring of the upper layer can be done before or after the lamination step; in either case, the score pattern should be substantially aligned with the adhesive areas.

Figure 4:
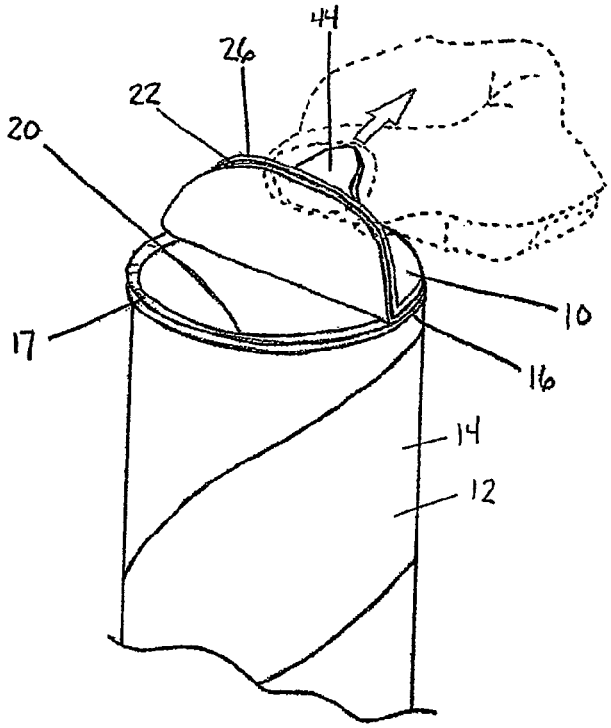
FIG. 4 is a partial perspective view of the container and membrane closure of FIG. 1 illustrating the membrane closure being removed from the container via the tab of the membrane closure.

FIGS. 3 and 4 provide an illustration of the removal of the membrane closure 10 from the container 12, according to an embodiment of the present invention. As shown in FIG. 3, a user may grab and pull the first tab area 44 near the apex 50 such that some or all of the first tab area 44 is lifted away from the lower layer 22 while the rest of the upper layer, i.e., the second fixed area 46, remains fixed to the lower layer 22. The relatively low peel strength of the first adhesive 54 compared to the ultimate strength of the first tab area 44 facilitates the lifting of the first tab area 44 along the lines of weakening 48, 49 from the inner point 50 toward the outer periphery 52. Although described as lifting, in the applications with perforated portions, the lifting may also include tearing along the weaken lines. The amount of force necessary to lift the first tab area 44 away from the lower layer 22 is generally considered an opening force.

The end of the lines of weakening 48, 49 adjacent the outer periphery 52 stop the lifting of the first tab area 44 such that the further pulling of the first tab area 44 will remove the membrane closure 10 from the container 12 as shown in FIG. 4. More particularly, the user provides a pulling force (i.e. the opening force) that is strong enough to overcome the peel strength of the first adhesive 54 that is holding the first tab area 44 to the lower layer 22 and to separate any perforations along the lines of weakening 48, 49. However, once the first tab area 44 is lifted and the ends of the lines of weakening 48, 49 are reached, in order to further lift the first tab area 44 or other portions of the upper layer 26 away from the lower layer 22, the pulling force would have to overcome the second adhesive 56 that is holding the second fixed area 46 of the upper layer to the lower layer 22 or the ultimate strength of the material of the upper layer 26. Furthermore, the lines of weakening 48, 49 near their ends extend generally perpendicular from the general direction of the pulling force which also increases the resistance of tearing more of the upper layer 26. Because the strength of the seam 36 between the lower layer 22 and the top end 16 of the container is effectively weaker than the strength of the second adhesive or the ultimate strength of the membrane closure 10, additional pulling causes the separation of the lower layer 22, and thus the membrane closure 10, from the top end 16 of the container along the seam 36. The force necessary to separate the lower layer 22 from the top end 16 along the seam 36 is generally considered a seal force.

Although the membrane closure is generally described above as being removed from the top end of the container, in some applications, it may be desirable to remove only a portion of the membrane closure from the top end. For example, in applications where the container stores a pourable product, the first tab area may be adapted for removing only a portion of the membrane closure from the top end of the container, such that the removed portion of the membrane closure defines a pourable opening from which to pour the product through.

Also, in other applications, the majority of the lower layer may be torn away from the top end of the container rather than separated along the seam. More specifically, as stated above, according to one embodiment, the end portions of the first tab area may include perforated portions that extend generally parallel and inside of the seam between the lower layer and top end of the container. Once the first tab area is lifted to the end portions, additional pulling may cause the lower layer to tear between the seam and the end portions due to the strength of the seam, strength of the second adhesive that is located between the end portions and the seam, and the strength of the material of the lower layer. Therefore, a portion of the lower layer may remain affixed to the top end of the container after the removal of the membrane closure.

Figure 6:
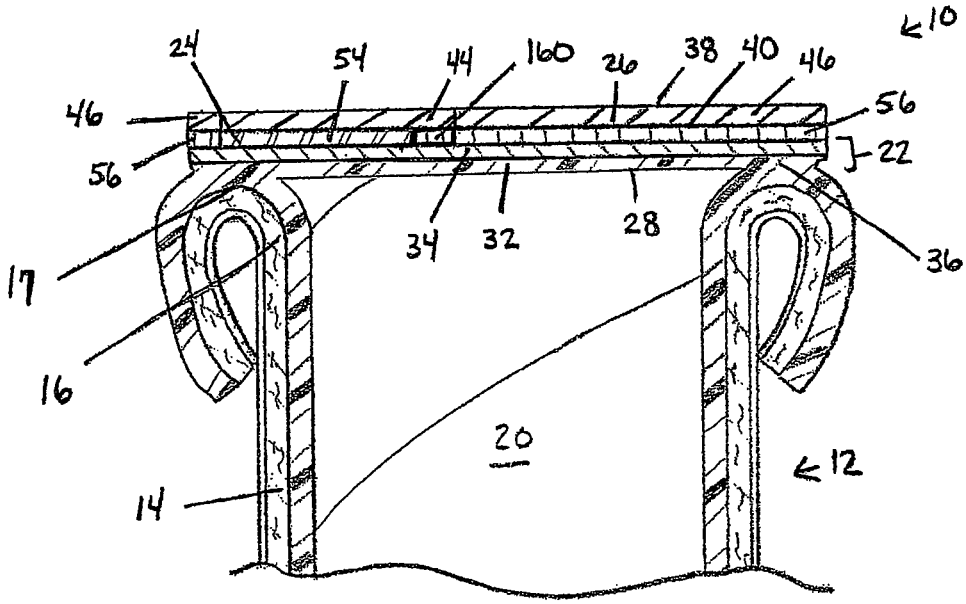
FIG. 6 is a cross-sectional view of the container and membrane closure in FIG. 5 taken along line 5-5.

The membrane closure 10 may also include an adhesive-free region 160 in the first tab area 44 to facilitate initial grasping of the first tab area 44, as illustrated in the embodiment of FIGS. 5 and 6. In the adhesive-free region 160, the upper layer 26 is not adhered to the lower layer 22. The adhesive-free region 160 preferably is located at the apex 50 of the first tab area 44.

Many modifications and other embodiments of the invention set forth herein will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A membrane closure comprising:

a lower layer;

an upper layer having a score pattern defining a first area and a second area, wherein the first area forms a tab;

an adhesive layer having a pattern-printed pressure-sensitive adhesive for attaching the first area to the lower layer in a manner allowing the tab to be grasped and peeled up from the lower layer, and a pattern-printed permanent laminating adhesive for attaching the second area to the lower layer, wherein the permanent laminating adhesive is stronger than the pressure-sensitive adhesive such that the second area of the upper layer remains substantially fixed to the lower layer while the tab is being pulled away from the lower layer.

2. The membrane closure according to claim 1, wherein the score pattern includes two opposite and symmetric lines of weakening that diverge from a common inner point and extend outwardly toward an outer periphery of the membrane closure, each line of weakening including an end portion adjacent the outer periphery.

3. The membrane closure according to claim 2, wherein the end portions of the lines of weakening extend along the outer periphery for a predetermined distance in opposite directions from each other.

4. The membrane closure according to claim 2, wherein the end portions of the lines of weakening extend generally away from the outer periphery.

5. The membrane closure according to claim 2, wherein each line of weakening includes a slit portion and a perforated portion.

6. The membrane closure according to claim 1, wherein the score pattern is non-symmetric.

7. The membrane closure according to claim 1, wherein the lower layer includes a barrier material for serving as a barrier to the passage of liquids and gasses.

8. The membrane closure according to claim 1, wherein the upper layer includes a top surface formed from a material not readily soiled.

9. The membrane closure according to claim 1, wherein there is an adhesive-free region between a portion of the tab and the lower layer.

10. A container for storing products, the container comprising:

a body defining an interior for storing products and an opening into the interior;

a membrane closure sealed to the body for closing the opening, the membrane closure including:

a lower layer having a bottom surface and a top surface, wherein the bottom surface is sealed to the body by a seam;

an upper layer having a score pattern defining a first tab area and a second fixed area;

an adhesive layer having a pattern-printed pressure-sensitive adhesive for attaching the first tab area to the top surface of the lower layer in a manner allowing the first tab area to be grasped and peeled up from the lower layer, and a pattern-printed permanent laminating adhesive for attaching the second fixed area to the top surface of the lower layer, wherein the permanent laminating adhesive is stronger than the first adhesive such that the second fixed area of the upper layer remains substantially fixed to the lower layer while the first tab area is being pulled away from the lower layer; and wherein at least a majority of the membrane closure is removable from the container substantially along the seam by pulling the first tab area.

11. The container according to claim 10, wherein the container is a paperboard container.

12. The container according to claim 10, wherein the container is a molded plastic container.

13. The container according to claim 10, wherein the score pattern includes two opposite and symmetric lines of weakening that diverge from a common inner point and extend outwardly toward an outer periphery of the membrane closure.

14. The container according to claim 13, wherein each line of weakening includes a slit portion and a perforated portion.

15. The container according to claim 10, wherein the bottom surface of the lower layer includes a heat sealable material for forming the seam between the lower layer and the body.

16. The container according to claim 10, wherein the lower layer includes a barrier material for serving as a barrier to the passage of liquids and gasses.

17. The container according to claim 10, wherein the upper layer includes a top surface formed from a material not readily soiled.

18. A membrane closure for a container, the membrane closure comprising:

a lower layer sealed to the container;

an upper layer having a score pattern defining a tab area and a fixed area; and an adhesive layer having a pattern-printed low-bond-strength peelable adhesive for releasably attaching the tab area to the lower layer and a pattern-printed permanent laminating adhesive for permanently bonding the fixed area to the lower layer;

wherein at least a portion of the lower layer is removable from the container by pulling the tab area.

19. The membrane closure according to claim 18, wherein the score pattern has a general V-shape with an open end near an outer periphery of the upper layer and a closed end near an inner point of the upper layer.

20. The membrane closure according to claim 18, wherein the score pattern includes a slit portion and a perforated portion.

21. The membrane closure according to claim 18, wherein the score pattern is non-symmetric.

* * * * *